US007806654B2

(12) United States Patent
Burgess

(10) Patent No.: US 7,806,654 B2
(45) Date of Patent: Oct. 5, 2010

(54) PUMP HOUSING ASSEMBLY WITH LINER

(75) Inventor: Kevin Edward Burgess, Carlingford (AU)

(73) Assignee: Weir Minerals Australia, Ltd., Artarmon, NSW ( * ) Notice: Subject to any disclaimer, the term of this patent is extended or adjusted under 35 U.S.C. 154(b) by 0 days.

(21) Appl. No.: 12/229,698

(22) Filed: Aug. 25, 2008

(65) Prior Publication Data

US 2009/0068002 A1 Mar. 12, 2009

Related U.S. Application Data

(63) Continuation-in-part of application No. 10/570,421, filed on Mar. 2, 2006, now Pat. No. 7,416,383.

(51) Int. Cl.
*F04D 29/42* (2006.01)

(52) U.S. Cl. ..... 415/196; 29/888.02; 29/888.021; 29/888.022; 29/888.024

(58) Field of Classification Search ..... 415/128, 415/172.1, 173.3, 173.4, 196–197, 214.1; 29/888.02, 888.021, 888.022, 888.024
See application file for complete search history.

(56) References Cited

U.S. PATENT DOCUMENTS

| | | | | |
|---|---|---|---|---|
| 797,058 | A | 8/1905 | Hedlund | |
| 1,952,179 | A | 3/1934 | Milkowski et al. | |
| 1,958,108 | A | 5/1934 | Milkowski | |
| 1,967,182 | A | 7/1934 | Allen | |
| 2,110,079 | A | 3/1938 | Butler | |
| 2,255,239 | A | 9/1941 | Allen | |
| 3,018,736 | A | 1/1962 | Clay | |
| 3,090,319 | A | 5/1963 | Musgrove | |
| 4,722,664 | A | 2/1988 | Wissman | |
| 4,917,571 | A | 4/1990 | Hyll et al. | |
| 4,974,998 | A * | 12/1990 | Heineman | 415/197 |
| 5,127,800 | A | 7/1992 | Hyll et al. | |
| 5,197,863 | A | 3/1993 | Dardis et al. | |
| 5,513,954 | A | 5/1996 | Bourgeois | |
| 5,941,536 | A | 8/1999 | Hill | |
| 6,582,191 | B2 | 6/2003 | Addie et al. | |
| 7,416,383 | B2 * | 8/2008 | Burgess | 415/196 |

FOREIGN PATENT DOCUMENTS

| | | |
|---|---|---|
| AU | 615 945 B2 | 10/1991 |
| FR | 2 218 489 A1 | 9/1974 |

OTHER PUBLICATIONS

Karassik, et al. (Editors), "Pump Handbook", McGraw-Hill Book Company, 1976, pp. 2-37, 2-38, Figs. 12 and 13.

* cited by examiner

*Primary Examiner*—Christopher Verdier
(74) *Attorney, Agent, or Firm*—Morris, O'Bryant, Compagni

(57) ABSTRACT

A pump housing assembly which includes a pump casing and a liner, where the pump casing includes at least two parts which are adapted to be connected together in an assembled position with the pump casing having opposed front and rear sides and a common junction region which is disposed within one or more planes which pass through the front and rear sides of the assembled pump casing, the liner being formed in one piece and having sealing portions that are activated to provide a seal between the liner and the pump casing.

17 Claims, 5 Drawing Sheets

PUMP HOUSING ASSEMBLY WITH LINER

CROSS-REFERENCE TO RELATED APPLICATION

This application is a continuation-in part-application of U.S. Ser. No. 10/570,421 filed Mar. 2, 2006, now issued as U.S. Pat. No. 7,416,383, to which priority is claimed.

BACKGROUND OF THE INVENTION

1. Field of the Invention

This invention relates generally to pumps such as for example end suction centrifugal pumps that have an outer casing and an internal liner. The invention is particularly suitable for slurry pumps that have an outer casing for withstanding the pressure and pipe loadings and an internal liner that is wear resistant and which in turn is supported by the outer casing.

2. Description of Related Art

Centrifugal slurry pumps typically utilise a cast outer casing made in Cast Iron or Ductile Iron with an internal liner moulded from a wear resisting elastomer compound. The casing and the liners are traditionally manufactured in two parts or halves held together with bolts at the periphery of the casing.

When assembled the two parts form a pump housing having a front side with an inlet therein and a rear side with a pumping chamber therein in which is disposed an impeller mounted for rotation on an impeller shaft. The impeller shaft enters the pumping chamber from the rear side and an outlet is provided at the peripheral side edge. The casing and liner halves are convex on the outside and have a concave shape on the inside. The liners normally have a metal skeleton moulded inside the elastomer which helps maintain its shape but also provides attachment points for bolts or studs to fix the liner into the casing halves. The two parts join along a plane which is generally perpendicular to the axis of rotation of the pump impeller.

During assembly, the two liner halves must be squeezed together at their periphery by the casing and casing bolts to effect a pressure tight seal. The resulting joint line is a vulnerable wear area in the pump, especially as the joint line is adjacent to the impeller discharge. Any misalignment of the liner halves along this joint line will produce steps or gaps in the joint line that will lead to preferential wear. Once wear starts at a local spot, the continued disturbed flow pattern at the step or gap will lead to an accelerated wear point and in the worst case localised wear will cause the liner to be worn through, thereby exposing the pressure containing casing to wear.

It is an object of the present invention to provide a pump housing assembly and including a liner which alleviates one or more of the aforementioned disadvantages.

BRIEF SUMMARY OF THE INVENTION

In accordance with the present invention, a liner is provided for positioning in a pump housing assembly that includes a pump casing having at least two parts which are adapted to be connected together in an assembled position where the pump casing includes opposed front and rear sides and the two parts of the pump casing, when in the assembled position, have a common junction region which is disposed within one or more planes that pass through the front and rear sides of the assembled pump casing. Methods of fitting the liner in the pump casing are also disclosed.

In one form of the invention, with the two parts of the pump casing having the common junction region disposed in a plane which is aligned with the axis of rotation of the impeller, the liner is desirably formed in one piece from an elastomer such as for example, rubber, synthetic rubber or other materials having similar properties of flexibility and durability. The liner includes an outer generally circular portion that encircles an axis that is parallel to or coaxial with the rotational axis of the impeller. The liner also includes annular flanges on each side of the outer circular portion which are adapted to be clamped between the two casing parts in the assembled position.

The flanges may include sealing portions. The sealing portions may be adapted to be received within a cavity formed between the pump casing and a pump end plate assembly. The sealing portion may be generally wedge shaped, formed integrally with the liner and is responsive to pressures produced before and during operation of the pump.

When in the assembled position, the liner is disposed within the pump casing and forms a pumping chamber for an impeller rotatable about a rotation axis which extends between the front and rear sides of the pump casing.

In another aspect of the invention, methods of fitting the liner in a pump casing are disclosed. Also disclosed are methods for activating the seal between the liner and casing when the liner is installed within the casing.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
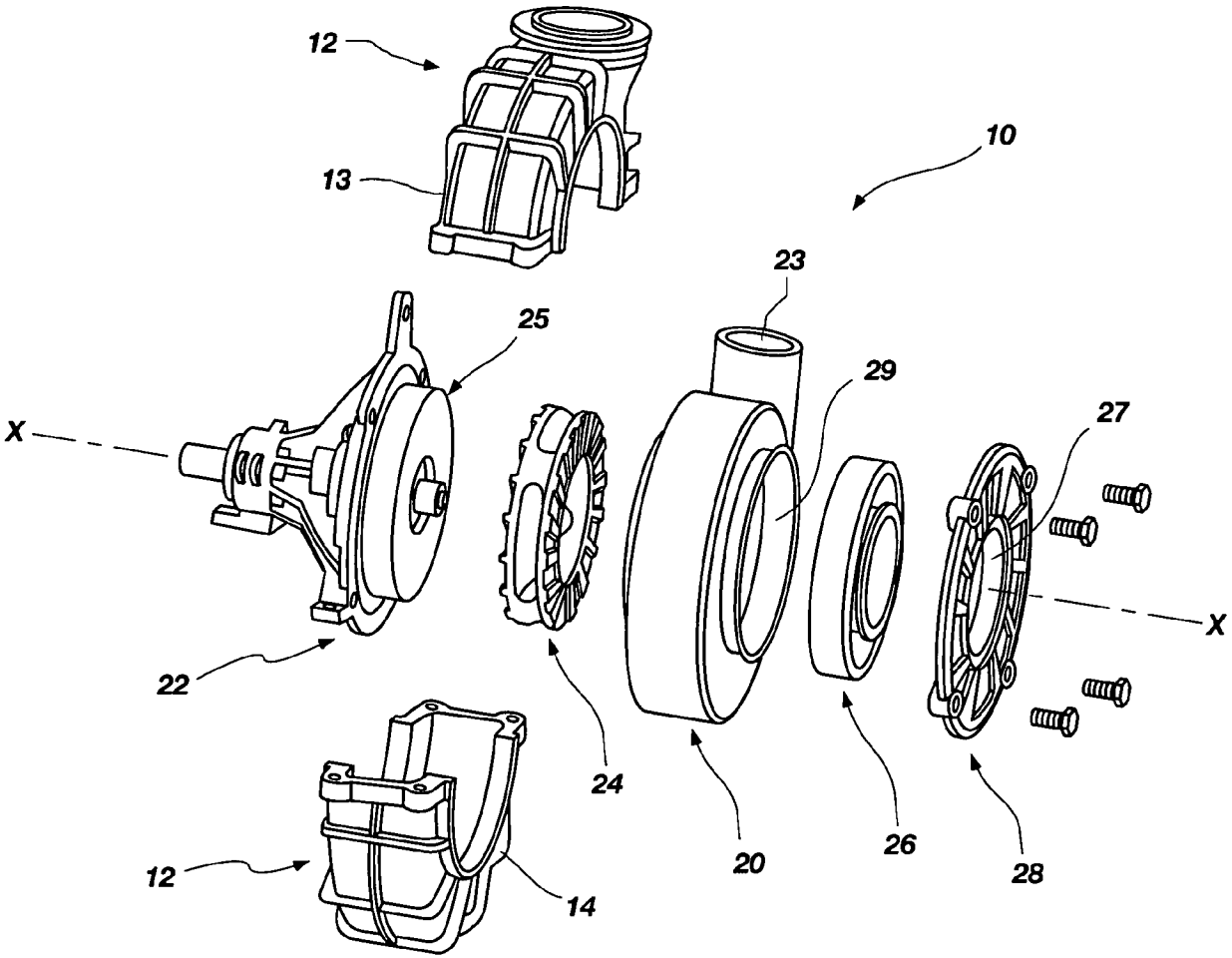
FIG. 1 is an exploded view of a pump according to the present invention.
Figure 2:
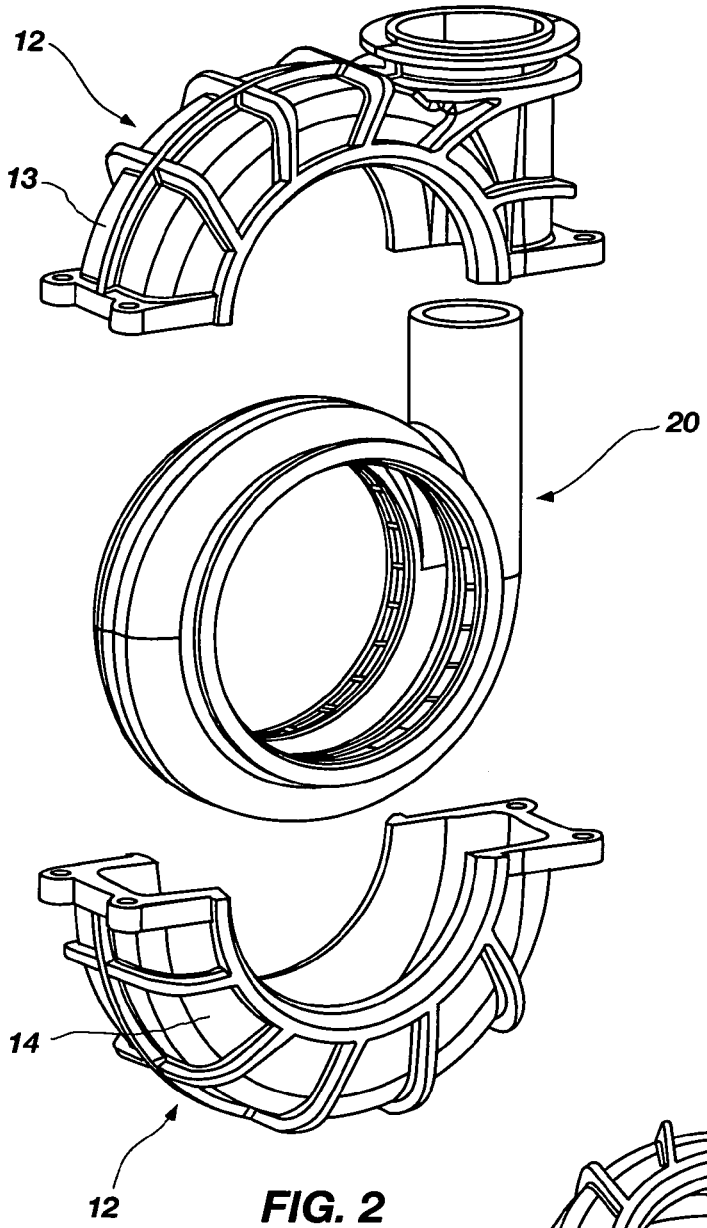
FIG. 2 is an exploded view of a pump housing assembly according to the present invention.

Referring to FIG. 1 of the drawings there is shown an exploded view of a pump generally indicated at 10 which includes a pump casing 12 having two parts 13 and 14 which can be assembled together, an elastomeric liner 20, a drive shaft assembly 22, an impeller 24, back and front side liners 25 and 26 (the front side liner is often referred to as the "throat bush") and an end plate 28.

In an assembled position, the impeller 24 is disposed within a pump chamber 29 and operatively connected to drive shaft assembly 22 for rotation and about rotation axis X-X. Slurry is drawn into the pump chamber 29 via inlet 27 and discharged through outlet 23 as is conventional.

Figure 3:
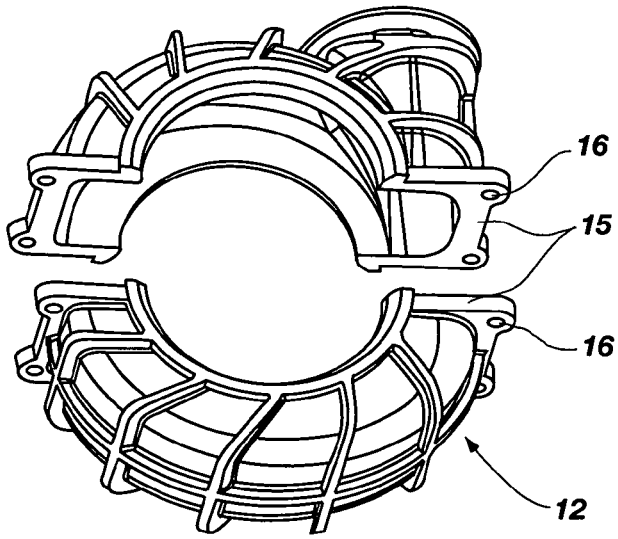
FIG. 3 is a schematic illustration of the two sections of the pump casing of the assembly shown in FIGS. 1 and 2.
Figure 4:
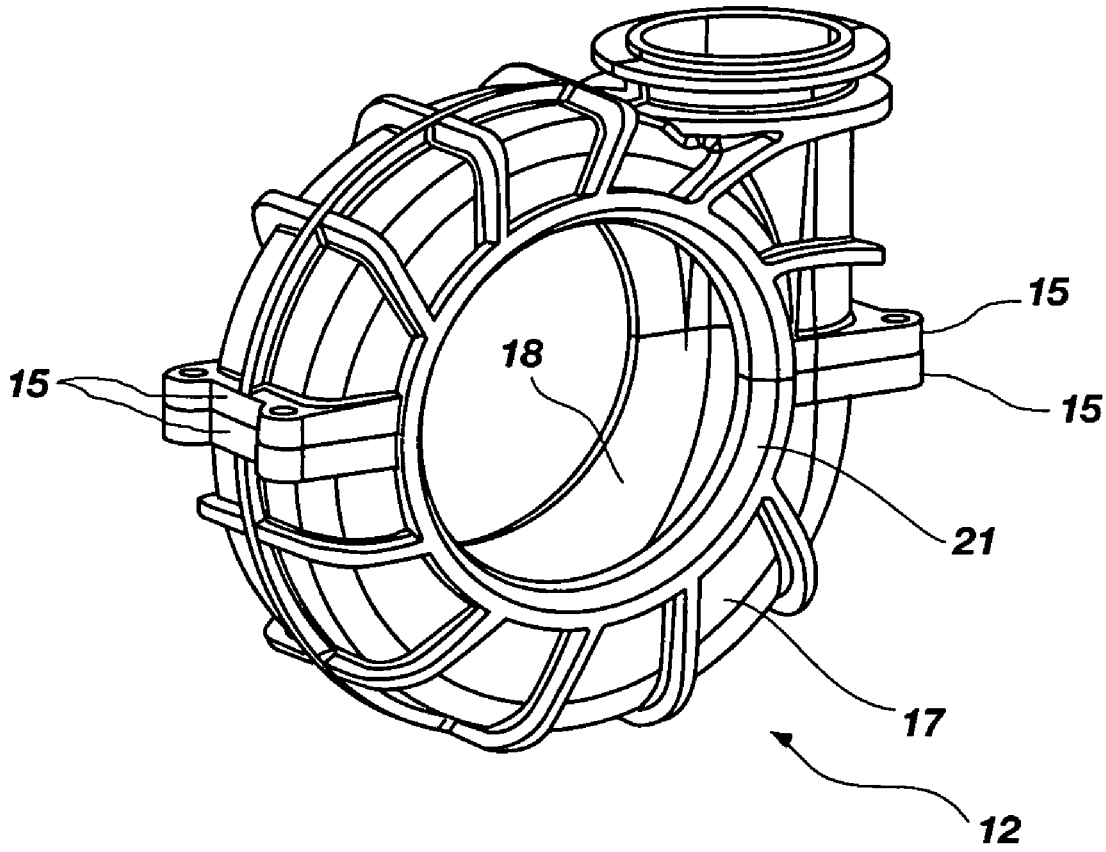
FIG. 4 is a schematic illustration of the pump casing shown in FIGS. 1 and 2 when assembled together.

The pump casing 12, as best seen in FIGS. 3 and 4, includes two parts 13 and 14 which can be fitted together. Flanges 15 on the pump casing parts 13, 14 have apertures 16 therein for receiving mounting bolts to hold the two parts 13, 14 together. In the assembled position, the pump casing 12 includes a front side 17 having an inlet 21 therein and a rear side 18 to which parts of the shaft assembly are operatively connected. The two parts 13 and 14 are fitted together in a plane which contains the axis of rotation X-X. Thus, the plane extends through the front and rear sides 17 and 18 of the casing when the pump is assembled.

Figure 5:
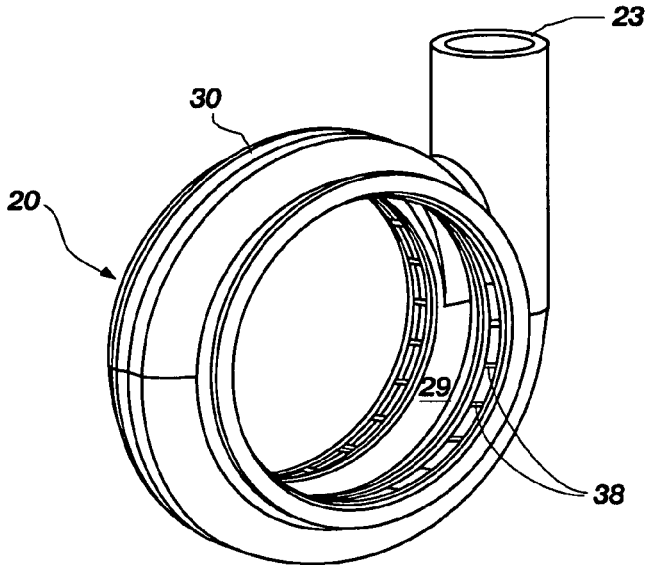
FIG. 5 is a perspective view of the liner shown in FIGS. 1 and 2.
Figure 6:
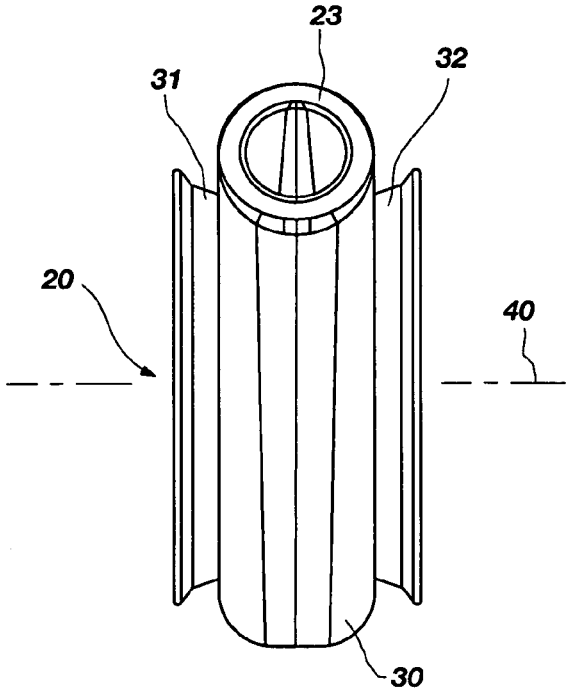
FIG. 6 is a side elevation view of the liner shown in FIG. 5.
Figure 7:
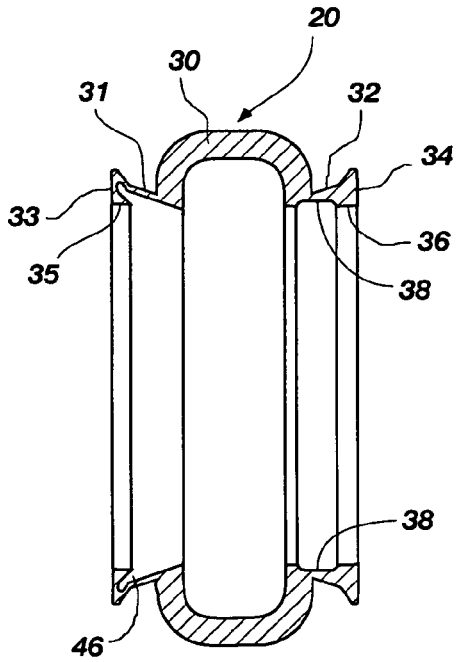
FIG. 7 is a view in cross section of the liner, the left side of the drawing figure showing a cross section through the flange and the right side of the drawing figure showing a cross section taken through the stiffening ribs.

The liner 20 is a one piece structure formed from a suitable elastomeric material. As best seen in FIGS. 5 to 7, the liner 20 includes an outer generally circular portion 30 that encircles an axis 40 that is parallel to or coaxial with the rotation axis X-X of the impeller 24 of the pump. Annular flanges 31 and 32 extend axially outwardly from the outer portion 30 of the liner 20 at an angle to the axis 40 of the liner 20, and are adapted or configured to be clamped within the pump casing parts 13 and 14.

Figure 8:
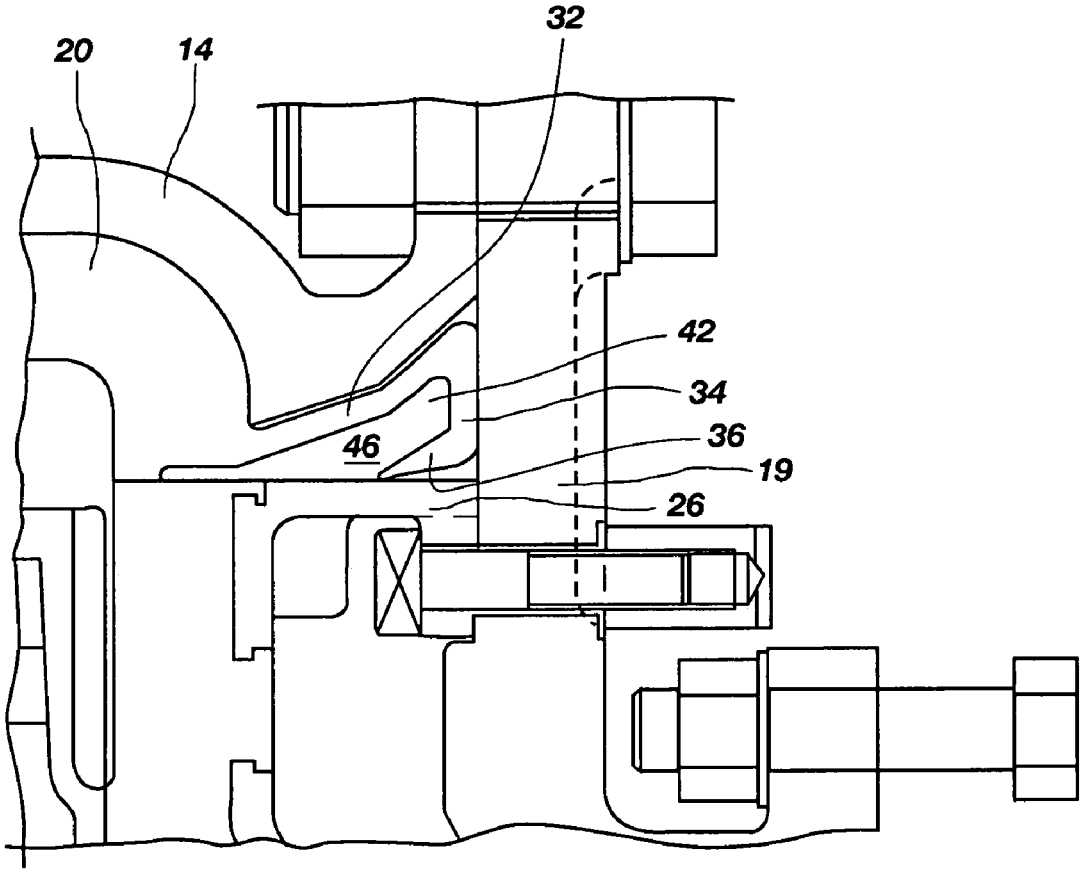
FIG. 8 is an enlarged view in cross section of out outer portion of the assembled pump illustrating the pump casing and liner arrangement.

The annular flanges 31 and 32 have seal portions 33 and 34 which extend from the flanges 31, 32 in a generally radial direction toward the axis 40 of the liner 20. Each seal portion 33, 34 may also include a flexible lip 35, 36 which, as shown, extends from the sealing portion 33, 34 at an orientation generally parallel to the flange 31, 32 with which it is associated. An annular cavity 46 is thus formed between the flange 32, seal portion 34 and flexible lip 36, as best seen in FIG. 8. Notably, a similar annular cavity is formed between the flange 31, seal portion 33 and flexible lip 35 on the other side of the liner 20, but is not shown in the illustrations.

The flanges 31 and 32 and associated seal portions 33 and 34 may have strengthening ribs 38 on the surface thereof as shown in FIG. 5. The section shown in FIG. 7 shows the configuration of the flange and seal portions 31 and 33 on the left side of the illustration, whereas the section on the right side is taken through one of the ribs 38. Strengthening ribs 38 may be optional and may not be required for some applications or pumps.

Referring to FIG. 8 the seal assembly is shown in an installed position. The seal portion 34 and flexible lip 36 are disposed within a cavity 42 formed between the casing 14 and the end plate assembly 19. The seal portion 34 fits within the cavity 42. The diameter of the flexible lip 36 is less than the outer diameter of side liner 26 so that the flexible lip is compressed during assembly of the side liner 26 into the liner 20; that is a seal is effected and flexible lip 36 ensures that the pump holds the static pressure when first filled. The cavity assists controlling the shape and pressure applied to the seal portion 34. During operation the annular cavity 46 is pressurized, the pressure acting on the seal to increase its sealing capacity.

The pump assembly is formed, as best illustrated in FIG. 1, by providing the two parts 13, 14 of the pump casing, the drive shaft assembly 22, end plate 28, back side liner 25 and front side liner 26, impeller 24 and the elastomer liner 20. The impeller 24 is positioned on the drive shaft assembly 22, the liner 20 is positioned within the two parts 13,14 of the pump casing and the front side liner 26 is positioned against the liner 20, as shown in FIG. 8. In the fitting of the liner 20 to the parts of the pump casing, the flanges 31, 32 and seal portions 33, 34 are positioned respectively within the cavity 42 formed between the back side liner 25 and front side liner 26 respectively.

The flanges 31, 32 and seal portions 33, 34 are then clamped into place with the attachment of the two parts 13, 14 of the assembled pump casing 12 to the drive shaft assembly 22 and attachment of the end plate 28 to the connected pump parts 13, 14, respectively. Pressure applied within the pump provides pressurization to the annular cavity 46 of the liner 20 and provides the seal as described herein.

Because the elastomer liner is produced in one-piece, it avoids the vertical joint line of conventional pumps and the weakness that it introduces due to wear at the joint line. Further the elastomer liner may not require an internal metal skeleton and consequently, the liner can be manufactured to a more uniform thickness or known high wear regions can be made thicker without affecting the liners manufacturability or compromising its wear life.

Further, without internal reinforcement, the elastomer liner will more easily conform to the internal shape of the pump casing due to the internal pump pressure generated while the pump is running. Any looseness or gaps between the metal casing and the liner are thereby minimized leading to a more robust liner as looseness and gaps will potentially lead to vibration and hysteresis heating of the elastomer and therefore reduced life.

As described earlier, to enable the liner to be held by the outer metal casing, a thickened region is provided around the liner horizontal centreline and an extension is provided on either side of the liner to allow clamping by the outer metal casing. The extension on either side of the rubber liner further includes an integral seal which is activated initially by the clamping provided by the outer casing and then by the internal pressure of the pumped fluid. With this arrangement, no internal metal skeleton or reinforcing may be required which also more easily facilitates the liner sealing when the liner is moulded in different elastomer compounds.

The liner being one piece without a vertical split line simplifies the casing design as well as obviating the need for casing bolts. The liner projection and seal on either side of the liner is made of a large enough diameter to allow the impeller to be installed through the side of the liner and as well to suit the side liners.

The outer casing is thereby required to be in two pieces to enable the fitment of the one-piece liner. It will be appreciated that the split line for the casing could be selected from a number of different positions. The requirements for casing bolts therefore reduce to a small number of bolts on the pump centerline. The casing bolts have the dual function of holding the casing halves together as well as squeezing the raised elastomer land to hold the liner in the casing.

The sides of the outer metal casing also assist in compressing and holding the elastomer projections and seals on both sides of the elastomer liner and prevent it from both being pushed out under pressure or being sucked in under vacuum. The metal casing can be produced either as two separate pieces or cast as one and then later split in the manufacturing cycle.

The use of a one-piece liner and two piece casing assists to lower maintenance costs. In most cases, the pump discharge pipework can be left attached to the pump. By removing the pump's suction pipework, front liner and impeller, it is possible to gain access to the pump internals for inspection.

The casing design may or may not have ribs for high-pressure applications. The casing bolts are designed to take the full design pressure without passing their elastic limit.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

What is claimed is:

1. A liner for a pump housing assembly, comprising:

a one-piece liner body having an outer portion encircling an axis, said outer portion defining a volute portion of said liner body;

spaced apart opposing sides extending radially from said volute portion toward said axis;

an annular flange extending axially outwardly from each said side;

a seal portion defining a segment that extends radially from each said annular flange in a direction toward said axis;

a flexible lip portion integrally formed with each said seal portion, said seal portion and flexible lip portion being configured for positioning between adjacent portions of a pump casing; and said flexible lip, seal portion and annular flange defining a cavity positioned to receive pressure forces produced by a pump when in operation, said cavity being configured to expand responsive to the said pressure forces to provide sealing between adjacent portions of a pump casing.

2. The liner according to claim 1 wherein each said flexible lip portion extends generally axially in a direction opposite said annular flange and is spaced from said annular flange to provide said cavity between said flexible lip portion and said annular flange.

3. The liner according to claim 1 wherein said liner is made of an elastomeric material.

4. The liner according to claim 1 wherein each said seal portion and adjacent annular flange are configured to form a wedge shape.

5. The liner according to claim 1 wherein each said flange extends from an opposing side of said liner body at an angle to said axis.

6. The liner according to claim 5 wherein each said flexible lip portion is spaced from the annular flange to which it is adjacently positioned and extends generally in parallel orientation to said annular flange.

7. The liner according to claim 1 wherein each said annular flange is formed with axially extending strengthening ribs.

8. The liner according to claim 7 wherein each said annular flange is formed with an inner surface oriented toward said axis, and said strengthening ribs are positioned on said inner surface of said annular flange.

9. A method of fitting a liner to a pump casing, comprising:

providing a pump casing having a volute section and opposing front and rear sides for positioning on either side and against said volute section to define a pump chamber for receiving an impeller mounted for rotation about a rotational axis, the adjacent positioning of said volute section and each said opposing front and rear sides forming a cavity;

providing a one-piece liner having annular flanges on opposing sides of said liner, each said annular flange having a sealing portion configured with an annular cavity that is positioned to receive pressure forces produced by a pump, when in operation, to provide a seal for adjacent portions of the pump casing adjacent to which the seal portion is positioned;

separating the front and rear sides of said pump casing from said volute section;

positioning said liner within said pump casing with said annular flanges positioned between said volute section and said front and rear sides, respectively, in a manner to position said annular cavity of said liner to receive the said pressure forces from the pump chamber for pressurization of the seal portion during operation of the pump;

joining said front side and rear side of said pump casing to said volute section thereby positioning said flanges of said liner between said volute section and said respective opposing front and rear sides.

10. The method according to claim 9, wherein said pump casing further comprises a pump end plate assembly configured for positioning against the volute section of the pump casing thereby providing a cavity between the volute section and the end plate assembly, the method further comprising locating the sealing portion of each said flange within said cavity formed between the volute section and said adjacent pump end plate assembly.

11. The method according to claim 10 wherein said annular flanges are of an elastomer material, the method further including the step of activating each said sealing portion responsive to pressure within the pump.

12. The method of claim 9 wherein the pump casing is comprised of two sections which, when in the assembled position, have a common junction region which passes through the front and rear sides of the assembled pump casing, said method further comprising joining the two sections of the pump casing prior to attaching the respective front and rear sides.

13. A liner for a pump housing assembly, comprising:

a one-piece liner body having an outer portion encircling an axis, said outer portion defining a volute portion of said liner body;

spaced apart opposing sides extending radially from said volute portion toward said axis;

an annular flange extending axially outwardly from each said side at an angle to a central axis of said liner body;

a seal portion extending radially from each said annular flange in a direction toward said axis;

a flexible lip portion integrally formed with and oriented generally parallel to said annular flange, said flexible lip portion being spaced from the annular flange to which it is adjacently positioned; and wherein said seal portion and flexible lip portion are configured for positioning between adjacent portions of a pump casing.

14. A liner for a pump housing assembly, comprising:

an elastomeric liner body having an outer portion encircling an axis, said outer portion defining a volute portion of said liner body;

spaced apart opposing sides extending radially inwardly from said volute portion toward said axis;

an annular flange extending axially outwardly from each said side, each said annular flange extending from an opposing side of said liner body at an angle to said axis;

a seal portion extending radially from each said annular flange in a direction toward said axis and forming a wedge shape with said annular flange; and a flexible lip portion integrally formed with each said seal portion, said seal portion and flexible lip portion being configured for positioning between adjacent portions of a pump casing, and each said flexible lip portion extending generally axially in a direction opposite said annular flange and being spaced from said annular flange to provide a cavity between said flexible lip portion and said annular flange, wherein said cavity is positioned to receive pressures produced during operation of a pump and to expand responsive to said pressures to provide sealing of adjacent portions of a pump casing.

15. The liner according to claim 14 wherein each said flexible lip portion is spaced from the annular flange to which it is adjacently positioned and extends generally in parallel orientation to said annular flange.

16. A liner for a pump housing assembly, comprising:

a liner body having an outer portion encircling an axis, said outer portion defining a volute portion of said liner body;

spaced apart opposing sides extending radially from said volute portion toward said axis;

an annular flange extending from each said opposing side;

a seal portion; and a flexible lip portion;

wherein said annular flange, seal portion and flexible lip portion are arranged to define an annular cavity configured for positioning between adjacent pump casing portions and to receive pressure produced by a pump during operation of the pump, and said annular cavity being configured to expand responsive to the pressure acting on the annular cavity to increase the seal capacity of the seal portion and flexible lip portion against a pump casing in which the liner is positioned.

17. A method of fitting a liner to a pump casing, comprising:

providing a pump casing having a volute section and opposing front and rear sides for positioning on either side of and adjacent said volute section to define a pump chamber for receiving an impeller that is mounted for rotation about a rotational axis, the adjacent positioning of said volute section and each said opposing front and rear sides forming a cavity therebetween, and the pump casing further comprising a pump end plate assembly configured for positioning against the volute section of the pump casing thereby defining the cavity between the volute section and each said opposing front and rear sides;

providing a one-piece elastomer liner having annular flanges on opposing sides of said liner, each said annular flange having a sealing portion configured with an annular cavity;

separating the front and rear sides and end plate assembly of said pump casing from said volute section;

positioning said liner within said pump casing with said annular flanges positioned between said volute section, said front and rear sides and said end plate assembly, respectively, in a manner to position said annular cavity of said liner for pressurization;

locating the sealing portion of each said flange within said cavity formed between the volute section and said adjacent sides and pump end plate assembly;

joining said front side, rear side and end plate assembly of said pump casing to said volute section thereby positioning said flanges of said liner between said volute section and said respective opposing front and rear sides and end plate assembly; and activating each said sealing portion responsive to pressure within the pump chamber.

* * * * *